US009670885B2

(12) United States Patent
Sano

(10) Patent No.: US 9,670,885 B2
(45) Date of Patent: Jun. 6, 2017

(54) FUEL APPARATUS FOR VEHICLE

(71) Applicant: MITSUBISHI JIDOSHA KOGYO KABUSHIKI KAISHA, Tokyo (JP)

(72) Inventor: Takayuki Sano, Okazaki (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 207 days.

(21) Appl. No.: 14/472,563

(22) Filed: Aug. 29, 2014

(65) Prior Publication Data

US 2015/0068499 A1 Mar. 12, 2015

(30) Foreign Application Priority Data

Sep. 11, 2013 (JP) ..... 2013-188333
Sep. 25, 2013 (JP) ..... 2013-198507

(51) Int. Cl.
*F02M 25/08* (2006.01)

(52) U.S. Cl.
CPC .... *F02M 25/0836* (2013.01); *F02M 25/0809* (2013.01); *F02M 2025/0845* (2013.01)

(58) Field of Classification Search
CPC ..... F02M 25/0809; F02M 25/0818; F02M 25/0827; F02M 25/089; F02M 25/0836; F02M 25/08; F02M 2025/0845; F02M 25/0854; F02M 2025/0881; F02M 25/0872; F02D 2041/225; F02D 41/003; F02D 41/0045; F02D 41/004; F02D 41/0042; B60K 15/03504; B60K 15/03519; B60K 2015/03566
USPC ..... 123/518–520, 514, 445
See application file for complete search history.

(56) References Cited

U.S. PATENT DOCUMENTS 5,373,823 A * 12/1994 Kuroda ..... F02M 25/0809 123/198 D
5,911,209 A * 6/1999 Kouda ..... F02M 25/0809 123/198 D
6,148,803 A * 11/2000 Majima ..... F02M 25/0809 123/520
6,814,063 B2 * 11/2004 Kawano ..... F02M 25/08 123/516

(Continued)

FOREIGN PATENT DOCUMENTS

JP 2013-19281 A 1/2013

*Primary Examiner* — Long T Tran
(74) *Attorney, Agent, or Firm* — Birch, Stewart, Kolasch & Birch, LLP

(57) ABSTRACT

A fuel apparatus includes a vapor passage for guiding evaporation gas in a fuel tank to a canister, a sealing valve for closing the vapor passage in normal condition to keep the interior of the fuel tank in a sealed state, a leak detection portion for detecting leak of the evaporation gas from the fuel tank in the sealed state to outside, and an opening control portion for opening the sealing valve when leak of the evaporation gas is detected. Alternatively, the fuel apparatus includes a bypass passage connecting an upstream portion of the vapor passage located upstream of the sealing valve and a downstream portion of the vapor passage located downstream of the sealing valve to each other to bypass the sealing valve, and a bypass valve provided in the bypass passage, for opening the bypass passage in the closed state when leak of the evaporation gas is detected.

6 Claims, 14 Drawing Sheets

(56) References Cited

U.S. PATENT DOCUMENTS

| | | | | |
|---|---|---|---|---|
| 6,829,921 | B2 * | 12/2004 | Isobe | F02M 25/0809 73/49.7 |
| 6,892,712 | B2 * | 5/2005 | Miwa | F02M 25/0809 123/198 D |
| 7,954,786 | B2 * | 6/2011 | Narita | F16K 31/0627 251/129.15 |
| 2005/0262932 | A1 * | 12/2005 | Hayashi | F02M 25/0827 73/114.39 |
| 2006/0090553 | A1 * | 5/2006 | Nagasaki | F02M 25/0818 73/114.43 |
| 2006/0207663 | A1 * | 9/2006 | Tsuge | F16K 31/0655 137/495 |
| 2013/0008414 | A1 * | 1/2013 | Matsunaga | F02M 25/0836 123/519 |
| 2013/0096774 | A1 * | 4/2013 | Takata | B60K 15/00 701/36 |

* cited by examiner

FUEL APPARATUS FOR VEHICLE

BACKGROUND OF THE INVENTION

Field of the Invention

The present invention relates to fuel apparatus for vehicles, and more particularly, to a fuel apparatus capable of restraining evaporation gas from leaking from within a sealed fuel tank to outside.

Description of the Related Art

In order to restrain evaporation gas in a fuel tank from being released into the atmosphere, a fuel apparatus for a vehicle, especially a fuel apparatus for a hybrid vehicle which is equipped with the combination of a traveling motor and an engine and in which the engine is less frequently operated employs a sealing system for sealing the interior of the fuel tank, to prevent the evaporation gas from leaking to the outside of the fuel tank.

In such sealing system, the evaporation gas in the fuel tank is disposed of (burned) by the engine while the engine is operating. Since the evaporation gas generated during refueling cannot be disposed of during refueling, however, the fuel apparatus with the sealing system includes a dedicated canister (for exclusive use during refueling), a vapor passage connecting the fuel tank and the canister, and a normally closed sealing valve for opening and closing the vapor passage. In normal condition, the sealing valve is closed to seal the interior of the fuel tank, and during refueling, the sealing valve is opened to guide the evaporation gas in the fuel tank to the canister, thereby allowing the evaporation gas to be adsorbed by the canister and preventing the evaporation gas from being released into the atmosphere from the filler port of the fuel tank (cf. Japanese Unexamined Patent Publication No. 2013-19281). The canister is purged during operation of the engine in a manner such that the evaporation gas adsorbed by the canister is guided to the intake side of the engine.

Also, for the purpose of management of the fuel tank, the fuel apparatus detects leak of the evaporation gas from the fuel tank in the sealed state.

For example, in the aforementioned patent publication, a leak detection portion including a pressure sensor for detecting the pressure in the fuel tank and a control unit is used to determine whether or not the evaporation gas is leaking from the closed space in the fuel tank (closed space including the space in the fuel tank above the level of the fuel, a passage portion closed with the sealing valve and a passage portion up to the filler port closed with a fuel cap), at an appropriate time (at predetermined intervals of time, e.g. at intervals of five hours) while the ignition switch (IG) is on or while the ignition switch is off, for example, while the vehicle is parked with no occupants therein. If it is judged that the evaporation gas is leaking, the driver is notified of the leak by, for example, an indicator on the instrument panel of the vehicle, thereby urging the driver to take appropriate measures.

The sealing valve remains closed after detection of leak of the evaporation gas from within the fuel tank is completed, and accordingly, if the evaporation gas is actually leaking from a certain spot, it keeps leaking from the leaky spot without being guided to the canister. Thus, while the vehicle is parked, for example, all of the evaporation gas in the fuel tank may possibly be released into the atmosphere without being noticed by the driver.

SUMMARY OF THE INVENTION

An object of the present invention is therefore to provide a fuel apparatus for a vehicle whereby, when leak of evaporation gas from within a fuel tank is detected, release of the evaporation gas from a leaky spot into the atmosphere can be reduced to a minimum.

To achieve the object, a fuel apparatus for a vehicle according to the present invention includes: a fuel tank storing fuel; a canister capable of adsorbing evaporation gas of the fuel produced in an interior of the fuel tank; a vapor passage connecting the interior of the fuel tank and the canister to each other to guide the evaporation gas in the fuel tank to the canister; a sealing valve provided in the vapor passage and, in normal condition, closing the vapor passage to keep the interior of the fuel tank in a sealed state; a leak detection portion which detects leak of the evaporation gas from a closed space of the fuel tank in the sealed state to outside; and an opening control portion which opens the sealing valve when leak of the evaporation gas from within the fuel tank is detected by the leak detection portion.

In this manner, when leak of the evaporation gas from within the closed space of the fuel tank is detected, the sealing valve which has been closing the vapor passage is opened, whereby most part of the evaporation gas is guided to the canister through the vapor passage (flow resistance: small), which has a larger flow passage area than a minute leaky spot.

Thus, even in the event that the evaporation gas leaks to the outside of the fuel tank, the evaporation gas released from the leaky spot can be reduced to a minimum.

In another aspect of the present invention, the fuel apparatus for a vehicle includes a bypass passage connecting an upstream portion of the vapor passage located upstream of the sealing valve and a downstream portion of the vapor passage located downstream of the sealing valve to each other to bypass the sealing valve, and a bypass valve which opens the bypass passage in a closed state when leak of the evaporation gas from within the fuel tank is detected by the leak detection portion.

In this manner, when leak of the evaporation gas from the closed space of the fuel tank is detected, the sealing valve is left as it is (closed) while the bypass passage is opened, whereby most part of the evaporation gas is guided to the canister through the bypass passage and then through the vapor passage (flow resistance: small), which has a larger flow passage area than the minute leaky spot.

Thus, even in a situation where the evaporation gas leaks to the outside of the fuel tank, release of the evaporation gas from the leaky spot can be minimized.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION OF THE INVENTION

A first embodiment of the present invention will be described below with reference to FIGS. 1 to 7C.

Figure 1:
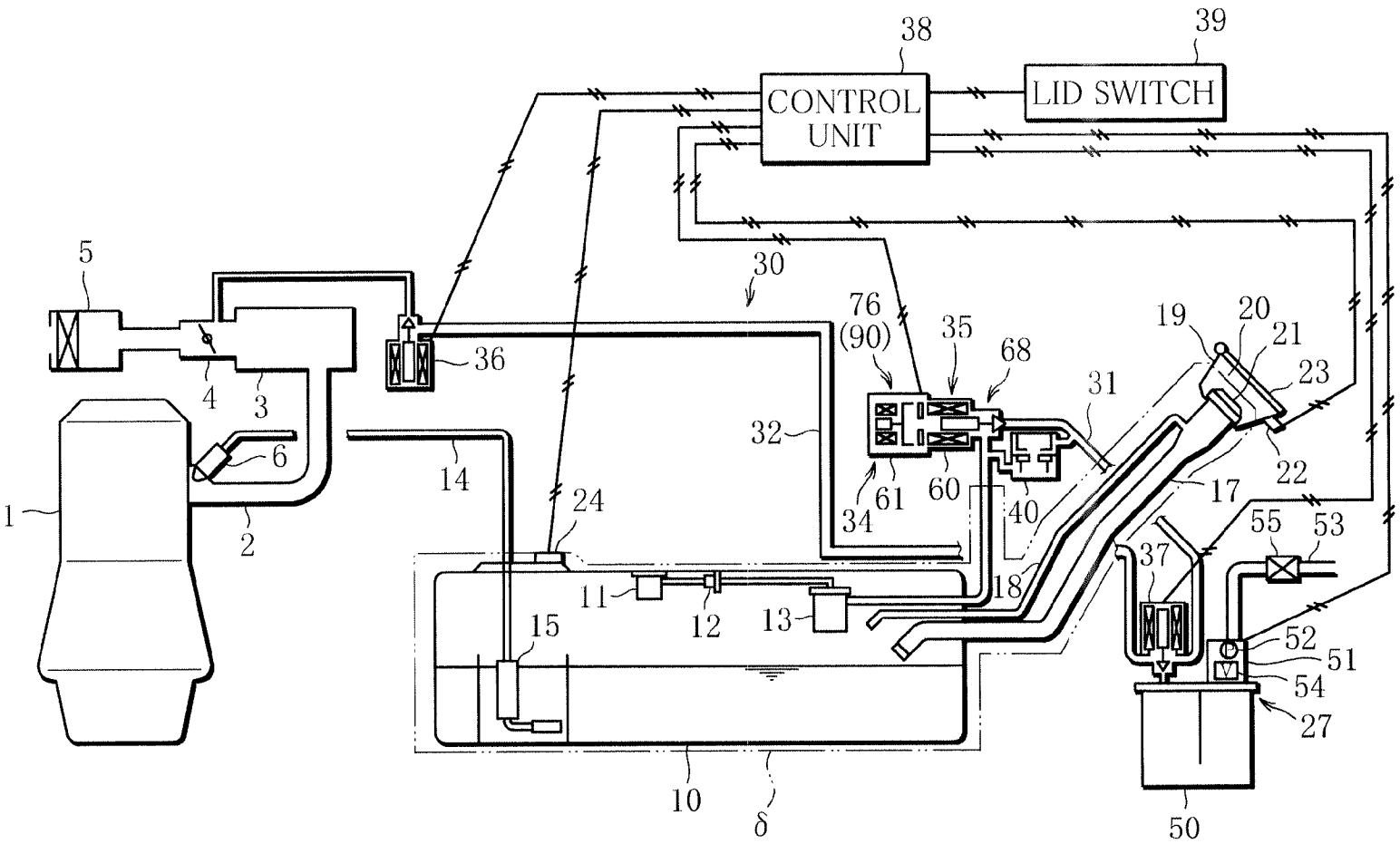
FIG. 1 illustrates a schematic configuration of a vehicular fuel apparatus according to a first embodiment of the present invention.

FIG. 1 illustrates a schematic configuration of a fuel apparatus according to a first embodiment of the present invention applied to a vehicle, for example, a hybrid vehicle using the combination of a traveling motor and an engine, and FIGS. 2 to 7C illustrate structures of various parts of the fuel apparatus and the manner of how the various parts are operated and controlled.

In the fuel apparatus illustrated in FIG. 1, reference numeral 1 denotes a reciprocating engine (corresponding to the engine), 10 denotes a fuel tank storing fuel (liquid fuel such as gasoline), 30 denotes an evaporation gas disposal portion for disposing of an evaporation gas in the fuel tank 10, and 50 denotes a dedicated canister (for exclusive use during refueling) associated with the evaporation gas disposal portion 30.

The engine 1, which is used in combination with a traveling motor, is provided at its intake side with an intake manifold 2, a surge tank 3, a throttle valve 4 and an air cleaner 5 (these devices constitute an intake passage of the engine 1). A fuel injector 6 is attached to the intake manifold 2.

The fuel tank 10 is, for example, a flat tank. A fuel cut valve 11 (constituted, e.g., by a float valve) and a leveling valve 13 (constituted, e.g., by a float valve) connected to the fuel cut valve 11 via a two-way valve 12 are arranged in an upper internal portion of the fuel tank 10. A position near a lower opening of the leveling valve 13 where the opening is closed with the surface of fuel is defined as a fill-up position.

A fuel pump 15 is arranged at a bottom portion of the interior of the fuel tank 10. A fuel passage 14 extending from a discharge portion of the fuel pump 15 is connected to the fuel injector 6 such that the fuel in the fuel tank 10 is supplied from the fuel injector 6 to a combustion chamber (not shown) of the engine 1. Although not shown, a return passage extends from the fuel injector 6 to the fuel tank 10. The fuel supply pressure may be adjusted in the fuel tank 10 so that the fuel may be returned there (not shown).

Also, a side wall of the fuel tank 10 is provided with a fuel pipe 17 and a recirculation pipe 18 for refueling. The fuel pipe 17 has an outlet portion connected to an intermediate portion of the side wall of the fuel tank 10, for example, and has an inlet portion connected to a fuel box 19 located, for example, above the fuel tank 10 to constitute a filler port 20. The filler port 20 can be opened and closed with a fuel cap 21, and the opening of the fuel box 19 is closed with a swingable fuel lid 23. The fuel lid 23 is releasably locked by a lid actuator 22. With the fuel lid 23 unlocked, the fuel cap 21 is detached, whereupon fuel can be fed from a refueling nozzle of refueling equipment (neither of which is shown) into the fuel tank 10 through the filler port 20. A pressure sensor 24 for detecting the internal pressure of the fuel tank 10 is attached to a top wall of the fuel tank 10. Alternatively, the pressure sensor may be attached to a portion of a vapor passage 31 connecting between the upper internal space of the fuel tank 10 and a sealing valve 35, described later (though not shown).

The recirculation pipe 18 has one end connected to the fuel pipe 17 at a location near the filler port 20. The other end of the recirculation pipe 18 penetrates through an upper portion of the side wall of the fuel tank 10. An opening at the distal end of the recirculation pipe 18 is located near the fill-up position defined by the leveling valve 13, for example, slightly below the fill-up position, so that fuel can be smoothly fed into the fuel tank 10 up to the fill-up position.

The canister 50 is equipped with a device used for checking a fuel leak from within the fuel tank 10, namely, a leak check module 51. Specifically, the canister 50 is constituted by a container containing activated charcoal (not shown). Although not shown, the container has two communication ports, namely, an evaporation gas communication port and an atmosphere communication port. The evaporation gas communication port may be constituted by two communication ports (not shown), one connected to the fuel tank 10 and the other connected to the engine 1. The leak check module 51 is fitted to the atmosphere communication port. The leak check module 51 is a device obtained by modularizing devices used for checking (detecting) a fuel leak from within the fuel tank 10, such as a negative pressure pump 52, a selector valve 54 for connecting the container selectively to one of the negative pressure pump 52 and a vent pipe 53, and a pressure sensor (not shown) for detecting the pressure in the canister 50. The vent pipe 53 is fitted with a filter 55.

The evaporation gas disposal portion 30 comprises the combination of, for example, a vapor passage 31 connecting the leveling valve 13 and the evaporation gas communication port of the canister 50 to each other, a purge passage 32 connecting the canister-side end of the vapor passage 31 to the intake passage of the engine 1, for example, a portion of the intake passage between the surge tank 3 and the throttle valve 4, a normally closed sealing valve 35 provided in the vapor passage 31, a normally closed purge valve 36 provided in the purge passage 32, a normally open canister valve 37, and a control unit 38 (e.g. an electronic unit including a CPU, ROM, RAM and the like) for controlling the individual valves.

Specifically, the sealing valve 35 is arranged, together with a bidirectional safety valve 40, in an intermediate portion of the vapor passage 31. The purge valve 36 is arranged in an intermediate portion of the purge passage 32, and the canister valve 37 is arranged at the evaporation gas communication port of the canister 50. These valves have such characteristics as to constitute a sealing system for sealing the interior of the fuel tank 10 in normal condition. Specifically, normally a region δ enclosed by the dot-dot-dash line in FIG. 1, that is, a closed space of the fuel tank 10 including the space in the fuel tank 10 above the level of the fuel, a portion of the purge passage closed with the sealing valve 35 and a portion of the fuel pipe closed with the fuel cap 21 is kept in a sealed state so that the evaporation gas (gas of evaporated fuel) in the fuel tank 10 may not leak to the outside of the fuel tank 10.

To dispose of the evaporation gas in the fuel tank 10, the control unit 38 has the function of opening the purge valve 36 and the sealing valve 35 and closing the canister valve 37 when the engine 1 is operated under a predetermined condition, for example. By virtue of this function, the evaporation gas in the fuel tank 10 is guided to the intake passage of the operating engine 1 through the fuel cut valve 11, the leveling valve 13, the vapor passage 31 and the purge passage 32, and is disposed of (burned) in the engine 1.

Also, the control unit 38 has a function whereby the evaporation gas in the fuel tank 10 is prevented from being released from the filler port 20 into the atmosphere during refueling. The function includes, for example, opening the sealing valve 35 and switching the selector valve 54 of the leak check module 51 to the atmospheric vent side (the negative pressure pump 52 may be operated instead) when a lid switch 39 is operated to unlock the fuel lid 23. Thus, during refueling, the fuel tank 10 is released from the sealed state and the evaporation gas in the fuel tank 10 is guided to the canister 50 through the fuel cut valve 11, the leveling valve 13, the vapor passage 31 and the canister valve 37, whereby the evaporation gas is prevented from being emitted to the atmosphere through the filler port 20 (the evaporation gas is adsorbed by the activated charcoal).

To prevent fuel from flowing out of the filler port 20 during refueling (due to rise in the internal pressure of the fuel tank), the control unit 38 has the function of opening the fuel lid 23 (unlocking the fuel lid 23 by the lid actuator 22) after the pressure in the fuel tank 10 is sufficiently lowered by opening the sealing valve 35.

Also, for the purpose of management of the sealing system, the control unit 38 has a leak check function whereby the fuel tank 10 is checked for sealability. The leak check function includes, for example, the function of operating the negative pressure pump 52, switching the selector valve 54 to the negative pressure pump side and opening the sealing valve 35 at an appropriate time, for example, while the ignition switch (IG) of the vehicle is on or off (while the vehicle is parked), to lower the internal pressure of the fuel tank 10 to a predetermined pressure by means of the negative pressure generated by the negative pressure pump 52, the function of leaving the fuel tank 10 in the sealed state with its internal pressure kept at the predetermined pressure, and the function of determining, based on change of the internal pressure of the fuel tank 10 after a lapse of a predetermined time, detected by the pressure sensor 24, whether or not the evaporation gas is leaking from the region 5 including the fuel tank 10 (the closed space including the internal space of the fuel tank 10, the passage portion closed with the sealing valve 35, and the passage portion leading to the filler port 20 and closed with the fuel cap 21). If it is judged that the evaporation gas is leaking, the driver is notified of such leak by an indicator or the like on the instrument panel of the vehicle, thereby urging the driver to take appropriate measures. The leak check function, the leak check module 51 and the control unit 38 constitute a leak detection portion 27 for detecting leak of the evaporation gas from within the fuel tank 10.

The sealing valve 35 constituting the sealing system remains closed even after the leak check is performed, and thus if the evaporation gas is leaking from within the fuel tank 10, the gas keeps leaking from the leaky spot, with the result that all evaporation gas in the fuel tank 10 is released into the atmosphere. Especially where the vehicle is being parked with no occupant therein, for example, the evaporation gas in the fuel tank 10 is totally emitted to the atmosphere from the leaky spot without being noticed by the driver or the like.

The sealing valve 35 is therefore provided with an opening control portion 34 which, when leak of the evaporation gas is detected by the leak check, opens the vapor passage 31, that is, causes the sealing valve 35 to switch from a closed state to an open state.

The fuel tank 10 is required to keep its sealed state for a long period of time, as while the vehicle is parked. For this reason, a normally closed electromagnetic on-off valve 60 is usually used as the sealing valve 35.

Thus, as illustrated in FIG. 1, the sealing valve 35 is constituted by a combination of the normally closed electromagnetic on-off valve 60 and a structure for changing the state of the on-off valve 60 to a normally open state. In the illustrated example, the electromagnetic on-off valve 60 is combined with a separate, dedicated changeover mechanism 61 (corresponding to the changeover portion), for example, as the opening control portion 34. An overall structure of the electromagnetic on-off valve 60 and of the changeover mechanism 61 is illustrated in FIGS. 2 and 6A to 6C, and a principal part of the structure is illustrated in FIGS. 3 and 7A to 7C.

Referring to these figures, the structure of the electromagnetic on-off valve 60 and the changeover mechanism 61 will be described. The electromagnetic on-off valve 60 comprises a solenoid 67 and a valve portion 68. The solenoid 67 includes, for example, an inner cylinder 62 formed as a slender cylindrical yoke, an annular winding of coil 63 disposed around the inner cylinder 62, an outer cylinder 64 formed as a cylindrical yoke with a greater diameter than the inner cylinder 62 and disposed around the coil 63, and a plunger 66 received, together with a return spring 65, in the inner cylinder 62 for reciprocating motion. The valve portion 68 is arranged at a distal end of the inner cylinder 62. Also, the valve portion 68 includes an L-shaped valve body 70 having a flow passage 69 formed therein, a pair of communication ports 71*a* and 71*b* provided at respective ends of the valve body 70, a valve seat 72 formed in the communication port 71*a*, and a valve member 73 capable of moving into contact with and away from the valve seat 72. The communications ports 71*a* and 71*b* are located in the middle of the vapor passage 31.

Figure 6A:
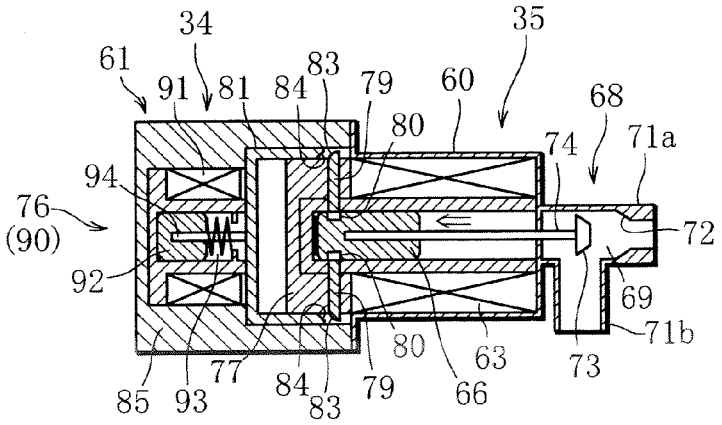
FIGS. 6A to 6C are sectional views illustrating how a lock moves while the sealing valve is changed from the normally closed state to the normally open state by the changeover control.
Figure 6B:
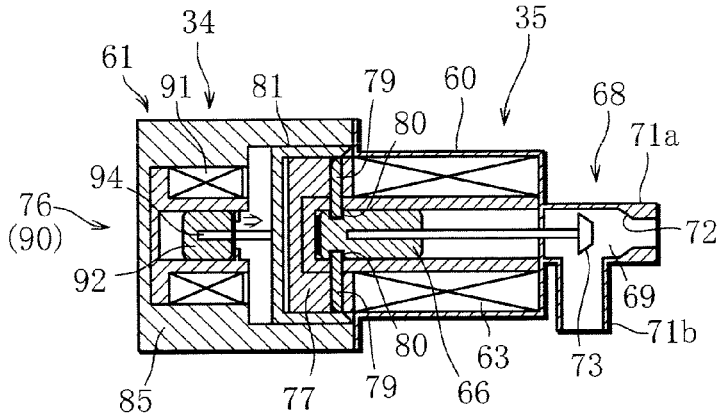

The plunger 66 and the valve member 73 are coupled by a connecting rod 74 so that the valve member 73 may be driven (opened or closed) as the solenoid 67 is energized or de-energized. That is, while the solenoid 67, more specifically, the coil 63, is de-energized (no current is supplied to the coil), the valve seat 72 is closed with the valve member 73 due to the elastic force of the return spring 65, and when the coil 63 is energized (current is supplied to the coil), the valve member 73 moves away from the valve seat 72 to open the communication port 71*a* (FIG. 6A). Namely, the electromagnetic on-off valve 60 is a normally closed type which closes the vapor passage 31 when the coil 63 is de-energized, and which opens the vapor passage 31 when the coil 63 is energized.

The changeover mechanism 61 includes a lock 75 attached to the solenoid 67, an actuator 76 arranged at a proximal end of the electromagnetic on-off valve 60, and the control unit 38, described later.

Figure 3:
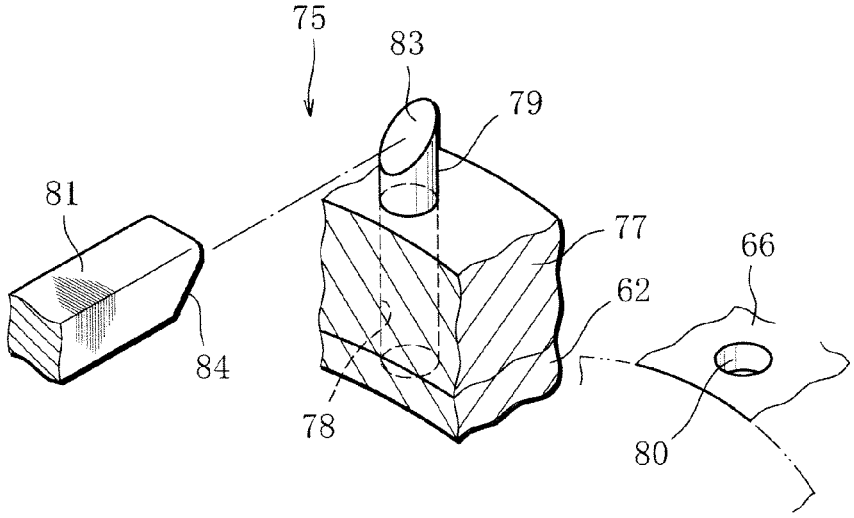
FIG. 3 is a perspective view illustrating the structure of a principal part of a changeover portion for changing the sealing valve from a normally closed state to a normally open state.

The lock 75 is capable of locking the valve member 73 in an open position. As illustrated in FIG. 3 by way of example, the lock 75 includes a through hole, in this embodiment, a pair of (two) through holes 78 penetrating diametrically through an annular yoke 77 fitted around the proximal end portion of the inner cylinder 62 and through the peripheral wall of the inner cylinder 62, a pair of (two) lock members, for example, a pair of lock pins 79 slidably received in the respective through holes 78, a pair of (two) locking holes 80 formed in the outer peripheral surface of the proximal end portion of the plunger 66, and a retainer 81 disposed axially slidably around the outer peripheral surface of the yoke 77.

Specifically, the two locking holes 80 formed in the outer peripheral surface of the plunger 66 are circumferentially shifted from each other by 180°, for example, and the two through holes 78 are so located as to face the respective locking holes 80 when the valve member 73 is in the open position. The locking holes 80 and the through holes 78 have an identical diameter and their open ends are aligned with each other when the valve member 73 is in the open position.

Figure 2:
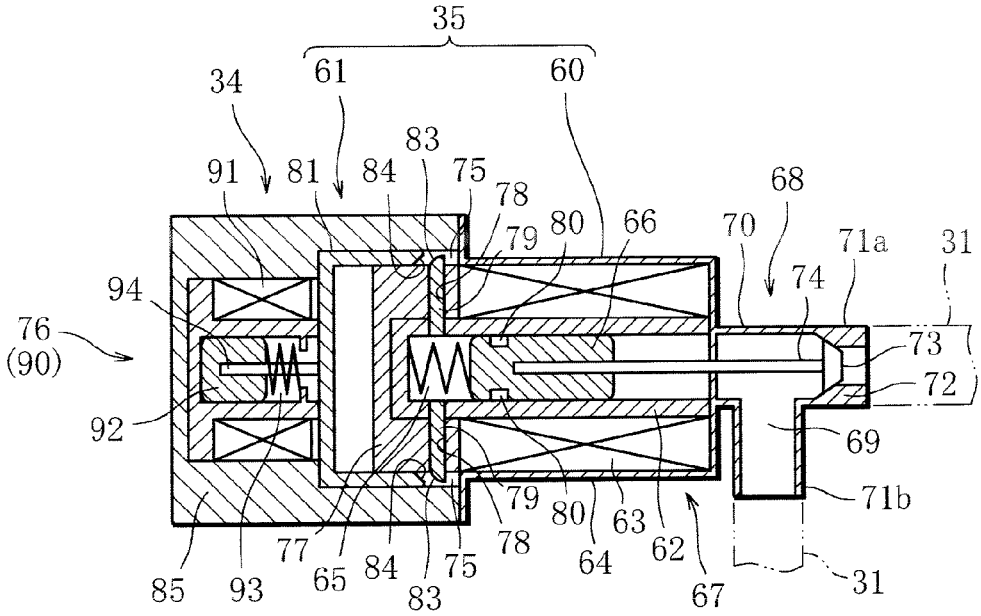
FIG. 2 is a sectional view illustrating the structure of a sealing valve of the fuel apparatus.

The lock pins 79 each comprise a member which is supported inside the inner peripheral surface of the corresponding through hole 78 by frictional force, for example, and which is axially displaced when applied with external force. Each lock pin 79 is arranged in such a manner that the plunger-side end is located in a position slightly short of the inner peripheral surface of the inner cylinder 62, for example (the plunger-side end may be flush with the inner peripheral surface of the inner cylinder 62 if no interference is caused) and that the opposite end slightly projects from the outer peripheral surface of the yoke 77. The projecting end portion of each lock pin 79 has a receiving surface 83 inclined obliquely from the proximal end toward the distal end of the inner cylinder 62, as illustrated in FIGS. 2, 3 and 6A.

The retainer 81 is, for example, a C-shaped member. The retainer 81 is arranged so as to hold the yoke 77 and has a pair of distal ends located in positions facing the receiving surfaces 83 of the respective lock pins 79. Each distal end portion of the retainer 81 has a pushing surface 84 inclined obliquely from the proximal end toward the distal end of the inner cylinder 62, as illustrated in FIGS. 2, 3 and 6A.

Thus, the lock 75 is configured such that as the retainer 81 is displaced forward (valve member 73: open position), the pushing surfaces 84 come into contact with the respective receiving surfaces 83 and then push (forcibly insert) the lock pins 79 into the respective through holes 78 to cause the opposite end portions of the lock pins 79 to fit into the respective locking holes 80, thereby restricting movement of the plunger 66, namely, locking the valve member 73 in the open position.

The actuator 76, which is a component for actuating the lock 75, comprises a dedicated solenoid 90. Specifically, as illustrated in FIGS. 2, 3 and 6A by way of example, the solenoid 90 includes a cylindrical yoke 85 closed at one end and coupled to the proximal end of the outer cylinder 64, an annular winding of coil 91 accommodated in the yoke 85, and a plunger 92 and a return spring 93 disposed inside the coil 91. The plunger 92 is coupled to the retainer 81 by a connecting rod 94 such that while the coil 91 is de-energized, the retainer 81 stays in a standby position at a distance from the lock pins 79, and when the coil 91 is energized, the plunger 92 is displaced toward the yoke 77 (until the ends of the retainer 81 are moved past the lock pins 79).

Both of the solenoid 90 and the solenoid 67 of the electromagnetic on-off valve 60 are connected to the control unit 38 so that when leak of the evaporation gas is detected, the sealing valve 35 can be switched to the open state, in other words, the normally open state. That is to say, the control unit 38 has a control function of performing leak check, energizing the solenoid 67 to open the electromagnetic on-off valve 60 when leak of the evaporation gas from within the fuel tank 10 to outside is detected, then energizing the solenoid 90 to move the retainer 81 forward until each lock pin 79 is brought to a locking position, and de-energizing the solenoids 67 and 90 thereafter. Specifically, when leak of the evaporation gas is detected, the through holes 78 and the locking holes 80 are aligned with each other by making use of the open position of the valve member 73. Subsequently, the valve member 73 is locked in the open position by energizing the solenoid 90, and although the solenoids 67 and 90 are de-energized thereafter, the valve member 73 is held in the open position. Thus, the state of the sealing valve 35 is changed to the normally open state, whereby leak of the evaporation gas from the leaky spot can be restrained.

Figure 4:
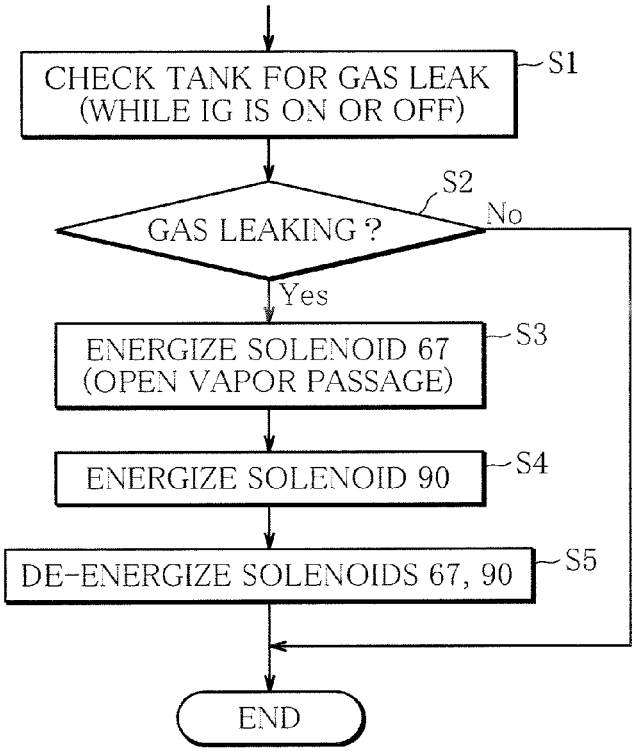
FIG. 4 is a flowchart illustrating a control procedure for changing the sealing valve from the normally closed state to the normally open state when a fuel leak from the closed space of a fuel tank is detected.

The control of restraining leak of the evaporation gas is illustrated in the flowchart of FIG. 4 and the timing chart of FIG. 5, and FIGS. 6A to 6C and 7A to 7C illustrate in detail the manner of how the sealing valve 35 is changed from the normally closed state to the normally open state by the control.

Referring now to FIGS. 4 through 7C, the technique of restraining leak of the evaporation gas will be explained. As shown in Step S1 of FIG. 4, leak of the evaporation gas from within the fuel tank 10 of the sealing system is checked at an appropriate time (e.g. at predetermined intervals of time) while the ignition switch (IG) is on or off.

The leak check is conducted by operating the negative pressure pump 52, switching the selector valve 54 and opening the sealing valve 35 to introduce the negative pressure generated by the negative pressure pump 52 into the fuel tank 10 until the internal pressure of the fuel tank 10 lowers to the predetermined pressure, then leaving the fuel tank 10 in the sealed state at the predetermined pressure, and determining, based on change of the internal pressure of the fuel tank 10 after a lapse of the predetermined time, whether or not the evaporation gas is leaking from the region δ including the interior of the fuel tank 10.

Figure 5:
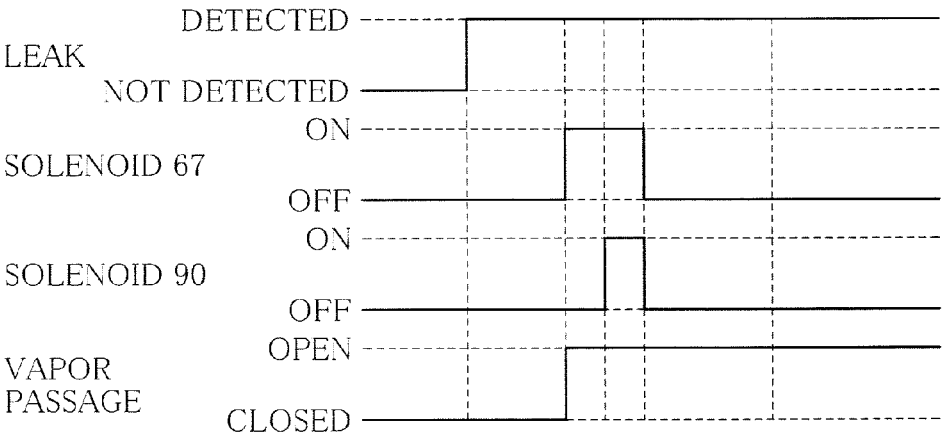
FIG. 5 is a timing chart illustrating the states of various parts during the changeover control.
Figure 7A:
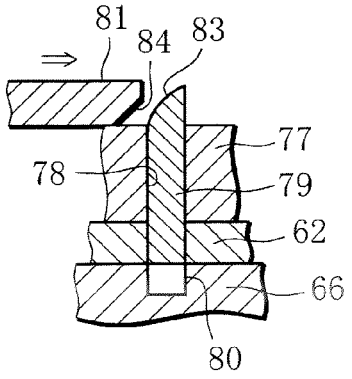
FIGS. 7A to 7C are sectional views illustrating how a valve member in an open position is locked.

If it is found at this time that the internal pressure of the fuel tank 10 has changed, it is concluded that there is a leaky spot in the region δ from which the evaporation gas in the fuel tank 10 is leaking to the outside, as indicated by "LEAK DETECTED" in FIG. 5. Thereupon, the flow proceeds from Step S2 to Step S3 in which the solenoid 67 is energized. Accordingly, the plunger 66 is retracted, moving the valve member 73 away from the valve seat 72. The vapor passage 31 opens as a result. Since the valve member 73 is moved to the open position, the locking holes 80 of the plunger 66 are located in alignment with the lock pins 79, as illustrated in FIGS. 6A and 7A.

Then, the flow proceeds to Step S4, in which the solenoid 90 is energized. Thereupon, the plunger 92 moves forward to advance the retainer 81 toward the ends of the lock pins 79 projecting from the outer peripheral surface of the yoke 77.

Figure 7B:
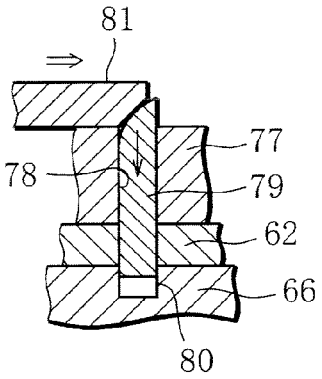
Figure 7C:
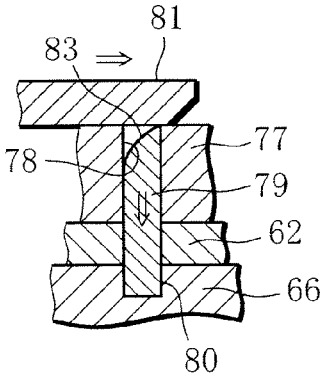
Figure 8:
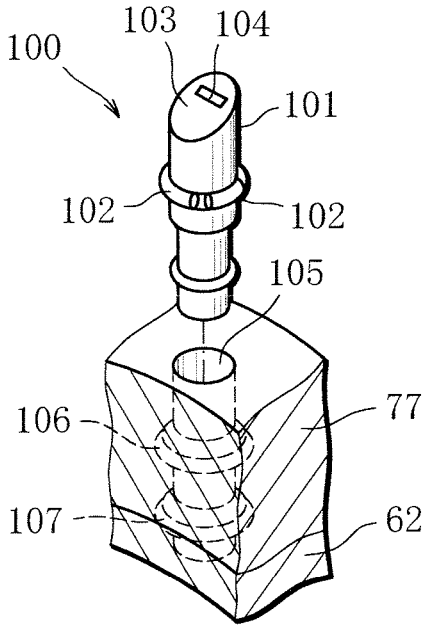
FIG. 8 is a perspective view illustrating the structure of a lock as a principal part of a second embodiment of the present invention.

The distal ends of the retainer 81 have the inclined pushing surface 84, and the projecting ends of the lock pins 79 have the receiving surfaces 83 inclined in the same direction as the pushing surfaces 84. Thus, as the pushing surfaces 84 abut against the respective receiving surfaces 83, the lock pins 79 are pushed into the yoke 77, as shown in FIGS. 7B and 7C. Accordingly, the opposite ends of the lock pins 79 are fitted into the respective locking holes 88 of the plunger 66. As a result, the plunger 66 is locked. Subsequently, the flow proceeds to Step S5, in which the solenoids 67 and 90 are de-energized. Consequently, the plunger 92 and the retainer 81 return to their standby position.

Figure 6C:
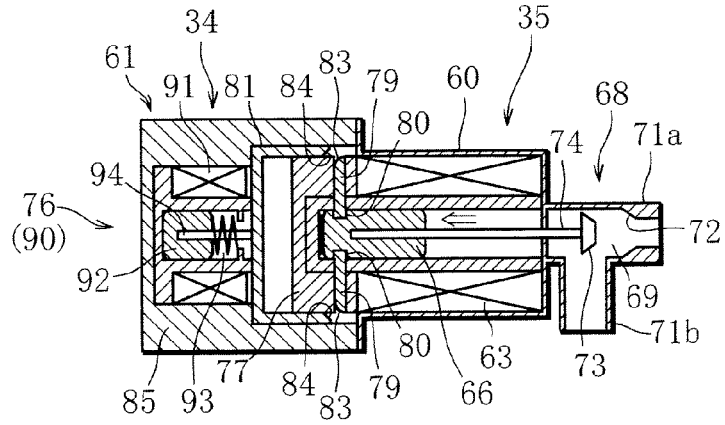

In this case, the lock pins 79 remain fitted in the locking holes 80 and keep their locking position, as illustrated in FIG. 6C, due to the force applied in the shearing direction by the return spring 65. That is, the valve member 73 remains locked in the open position, even though the solenoid 67 is de-energized. This completes the changeover from the normally closed state to the normally open state, and the sealing valve 35 continuously opens the vapor passage 31 thereafter.

In this manner, when leak of the evaporation gas from within the fuel tank 10 is detected, the sealing valve 35 is opened to continuously open the vapor passage 31, whereby most part of the evaporation gas is guided to the canister 50 through the vapor passage 31 (flow resistance: small), which has a larger flow passage area than the minute leaky spot, and is adsorbed by the activated charcoal in the canister 50. In this case, the selector valve 54 of the leak check module 51 is switched to the atmospheric vent side, in order to facilitate adsorption of the evaporation gas.

Thus, even in the event that the evaporation gas leaks to the outside of the fuel tank 10, most part of the evaporation gas is adsorbed in the canister 50, so that the evaporation gas released from the leaky spot of the fuel tank 10 can be reduced to a minimum.

Further, the normally closed electromagnetic on-off valve 60 constituting the sealing valve 35 has only to be combined with the changeover mechanism 61 (control unit 38, lock 75, actuator 76) for locking the valve member 73 in the open position in the de-energized state, to enable the sealing valve 35 to change to normally open state, whereby the vapor passage 31 can easily be kept open.

Especially, the electromagnetic on-off valve 60 is configured to be changed to normally open state, and thus, in a situation where leak of the evaporation gas from within the fuel tank 10 is detected while the vehicle is parked, it is possible to prevent wasteful consumption of the electric power of the battery mounted on the vehicle.

Moreover, the changeover mechanism 61 employs the combination of the lock 75 for locking the valve member 73 and the actuator 76 (solenoid 90) for actuating the lock 75, and accordingly, the vapor passage 31 can be caused to continuously open by making use of the existing normally closed sealing valve 35.

FIGS. 8 and 9A to 9D illustrate a second embodiment of the present invention.

The second embodiment is a modification of the first embodiment, and in the second embodiment, the valve member 73 can be manually unlocked.

Specifically, as illustrated in FIGS. 8 and 9A to 9D by way of example, a lock 100 comprises a lock pin 101 and a through hole 105. The lock pin 101 includes, for example, an elastic protuberance 102, in this embodiment, a plurality of elastic protuberances 102 formed on the outer periphery of the lock pin 101 and extending in a circumferential direction of the lock pin 101, and an unlocking groove formed in the projecting end of the lock pin 101, in this embodiment, a recovery groove 104 formed in a portion of a receiving surface 103 (the portion which can be seen from outside even in a locking position) and capable of engaging with an end of a tool (e.g. tip of a screwdriver 109). The through hole 105 has two annular grooves formed in an inner peripheral surface thereof and capable of engaging with the protuberances 102, that is, an unlocking (recovery) annular groove 106 and a locking annular groove 107. A ring 108 is fitted on the proximal end portion of the lock pin 101 to seal the gap between the outer peripheral surface of the lock pin 101 and the inner peripheral surface of the through hole 105.

Figure 9A:
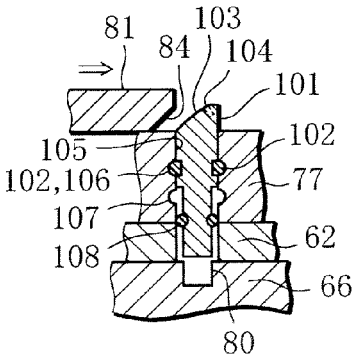
FIGS. 9A to 9D are sectional views illustrating movement of the lock.
Figure 9B:
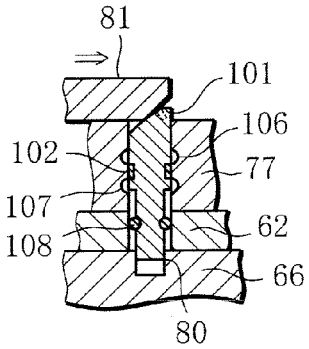
Figure 9C:
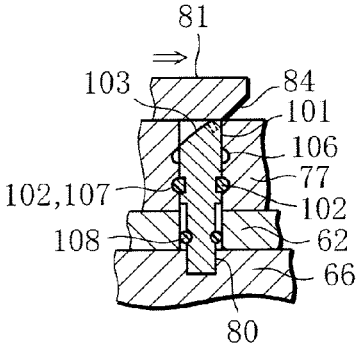
Figure 9D:
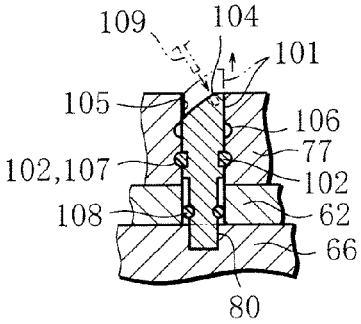

At first, the lock pin 101 of the lock 100 is held as shown in FIG. 9A such that the protuberances 102 are elastically engaged with the upper unlocking groove 106 with the inner end of the lock pin 101 located at a distance from the locking hole 80. When leak of the evaporation gas is detected, the valve member 73 is moved to the open position where the through hole 105 is aligned with the locking hole 80. Then, as the lock pin 101 is pushed in by the retainer 81, the inner end of the lock pin 101 fits into the locking hole 80 as illustrated in FIG. 9C. As the valve member 73 is locked by the lock pin 101, the protuberances 102 elastically engage with the lower locking groove 107, thus holding the valve member 73 in the open position. The valve member 73 is continuously held in the open position even after the solenoid 90 is de-energized, that is, the retainer 81 is retracted. In this manner, the sealing valve 35 is changed to the normally open state.

The evaporation gas in the fuel tank 10 is guided through the open sealing valve 35 to the canister 50, to restrain leak of the evaporation gas from the leaky spot. The leaky spot of the fuel tank 10 is mended at a repair shop or the like. Since the sealing valve 35 is locked in the normally open state, it is usually difficult to return the sealing valve 35 to the normally closed state after repair.

The recovery groove 104 is formed in the externally exposed receiving surface 103 of the lock pin 101. With a suitable tool, for example, the tip of the screwdriver 109 inserted into the groove 104 as indicated by the dot-dot-dash line in FIG. 9D, the lock pin 101 is pulled out until the protuberances 102 are again elastically engaged with the unlocking groove 106, so that the inner end portion of the lock pin 101 comes out of the locking hole 80. That is, the lock 100 is unlocked and the sealing valve 30 resumes the initial normally closed state (FIG. 9A).

Thus, after the leak of the evaporation gas is stopped, the sealing valve 35 can be reused repeatedly.

Further, the lock 100 can be manually unlocked. Thus, the valve member 73 may be previously locked in the open position (normally open position) when fuel is fed to a 0 vehicle on the line of a vehicle assembly factory, and in this case, fuel can be fed into the fuel tank 10 in the unsealed state, facilitating the feeding of fuel into the fuel tank 10 on the line, which can often be troublesome work. After the feeding of fuel is completed, the valve member 73 may be unlocked, whereupon the sealing valve 35 resumes the normally closed state, posing no particular problem.

FIGS. 10A to 12 illustrate a third embodiment of the present invention.

In this embodiment, movement of the valve member 73 of a normally closed electromagnetic on-off valve 110 constituting the sealing valve 35 is utilized to carry out changeover of the sealing valve 35 to normally open state, unlike the first and second embodiments in which the separate actuator is used to perform the changeover.

Specifically, a two-stage sliding solenoid 111 is used for the normally closed electromagnetic on-off valve 110. By switching the exciting voltage applied to the solenoid 111, the valve member 73 for opening and closing the vapor passage 31 shown in FIG. 10A can be located in either of a first open position α for normal use, and a second open position β for use in case of fuel leak, located farther from the closing position than the first open position α.

A changeover mechanism 115 (corresponding to the changeover portion) for changing the sealing valve 35 to normally open state includes a switching function (corresponding to the switching portion) of the control unit 38 whereby the exciting voltage is switched, and a locking portion 116 of the electromagnetic on-off valve 110 for restricting movement of the valve member 73. Specifically, the switching function is the function of applying, to the coil 63 of the solenoid 111, an exciting voltage required to displace the valve member 73 to the first open position α during normal use and, when leak of the evaporation gas is detected, applying to the coil 63 of the solenoid 111 an exciting voltage required to displace the valve member 73 to the second open position β. The locking portion 116 has a structure indicated by A in FIG. 10A, whereby movement of the valve member 73 displaced to the second open position β is restricted. In this embodiment, the locking portion 116 is constituted by a pin member 118 received within a hole in the plunger 66 and urged by an elastic member 117 so as to be able to project from the outer peripheral surface of the plunger 66, and a locking hole 119 formed in the inner peripheral surface of the inner cylinder 62 such that when the valve member 73 is displaced up to the second open position β, the pin member 118 is inserted into the locking hole 119 by the elastic force of the elastic member 117.

Figure 10A:
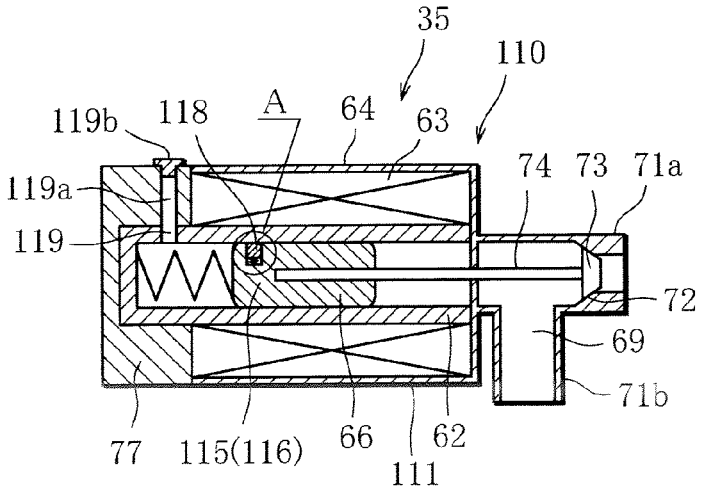
FIGS. 10A to 10C are sectional views illustrating the structure of a sealing valve as a principal part of a third embodiment of the present invention, the sealing valve being changed from the normally closed state to the normally open state.
Figure 10B:
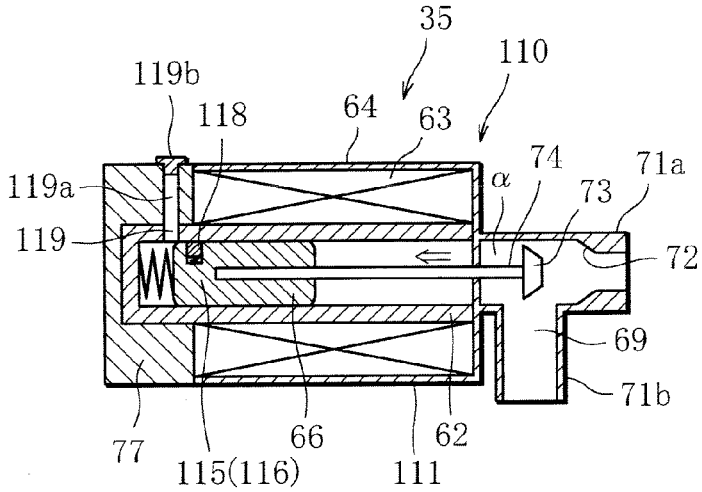
Figure 10C:
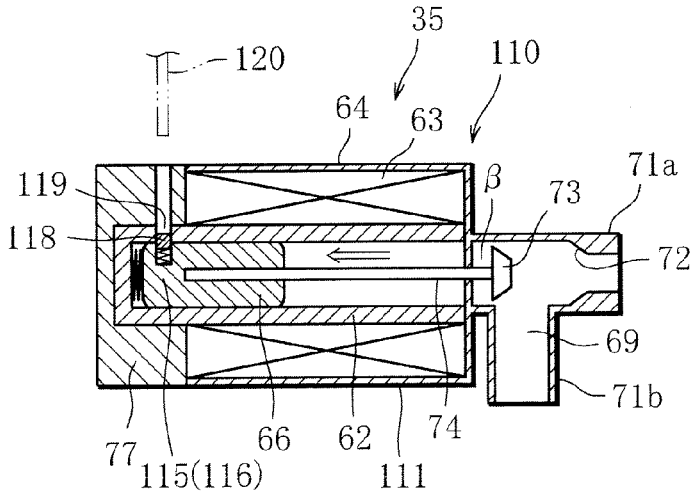
Figure 11:
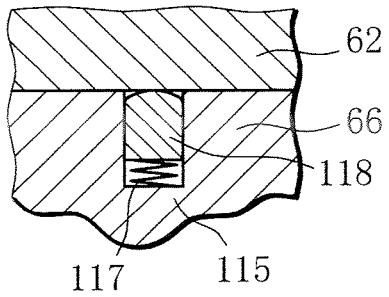
FIG. 11 is an enlarged sectional view of a locking portion indicated by A in FIG. 10A.
Figure 12:
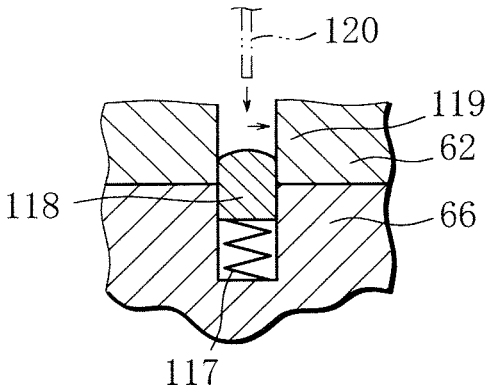
FIG. 12 is a sectional view illustrating a state in which a valve member is locked by the locking portion.

Normally, the sealing valve 35 is used with the solenoid 111 de-energized as shown in FIG. 10A, or by applying the exciting voltage to the solenoid 111 to displace the valve member 73 up to the first open position α as shown in FIG. 10B. That is, during normal use, the pin member 118 remains sunk in the plunger 66, as illustrated in FIG. 11. If it is found by the leak check that the evaporation gas in the fuel tank 10 is leaking, the coil 63 of the solenoid 111 is applied with an exciting voltage (higher than that applied to the coil 63 to attain the first open position α) needed to displace the valve member 73 up to the second open position β as shown in FIG. 10C. When the valve member 73 is moved to the second open position 13, the pin member 118 is aligned with the locking hole 119 as shown in FIG. 12, so that the pin member 118 enters the locking hole 119. Consequently, the plunger 66 is locked and movement of the valve member 73 is restricted. The solenoid 111 is thereafter de-energized and the sealing valve 35 is held in the normally open state, as in the foregoing embodiments.

Also with the above structure for changing the sealing valve 35 to normally open state, the same advantageous effects as those of the first embodiment can achieved. With the structure of this embodiment in particular, the valve member 73 is locked using the movement of its own, making it unnecessary to use an additional component such as an actuator. Accordingly, the number of components can be reduced, and also the structure of the sealing valve 35 can be simplified.

In this embodiment, the locking hole 119 is formed as a hole penetrating straight through the yoke 77 and opening to the outside so that the valve member 73 can be manually unlocked. A suitable tool, for example, the tip of a screwdriver 120 is inserted from outside the yoke 77 into the locking hole 119 as indicated by the dot-dot-dash lines in FIGS. 10C and 12, and the pin member 118 is pushed into the hole, whereupon the valve member 73 is unlocked. Thus, also in this embodiment, the same advantageous effect as that of the second embodiment can be achieved. The locking hole 119 is provided with a waterproof seal device. Specifically, the outer open end of the through hole portion 119*a* in the yoke 77 is closed with a lid member that is fitted into the through hole portion 119*a*, or with a detachable lid 119*b* such as a seal member affixed to the surface of the yoke 77.

In FIGS. 8 to 12, like reference numerals are used to denote like component parts of the first embodiment, and description of such component parts is omitted.

Although in the first to third embodiments, one or two lock pins or one pin member is used, the number of the lock pins or pin members to be used in the present invention is not particularly limited.

Also, in the first to third embodiments, the lock or the locking portion is actuated by moving the retainer with use of the actuator or by using the two-stage sliding type electromagnetic on-off valve. The structure to be used in the present invention is, however, not limited to the exemplified structures, and other suitable structure may be used to keep the sealing valve 35 open.

FIGS. 13 to 18 illustrate a fourth embodiment of the present invention.

Figure 13:
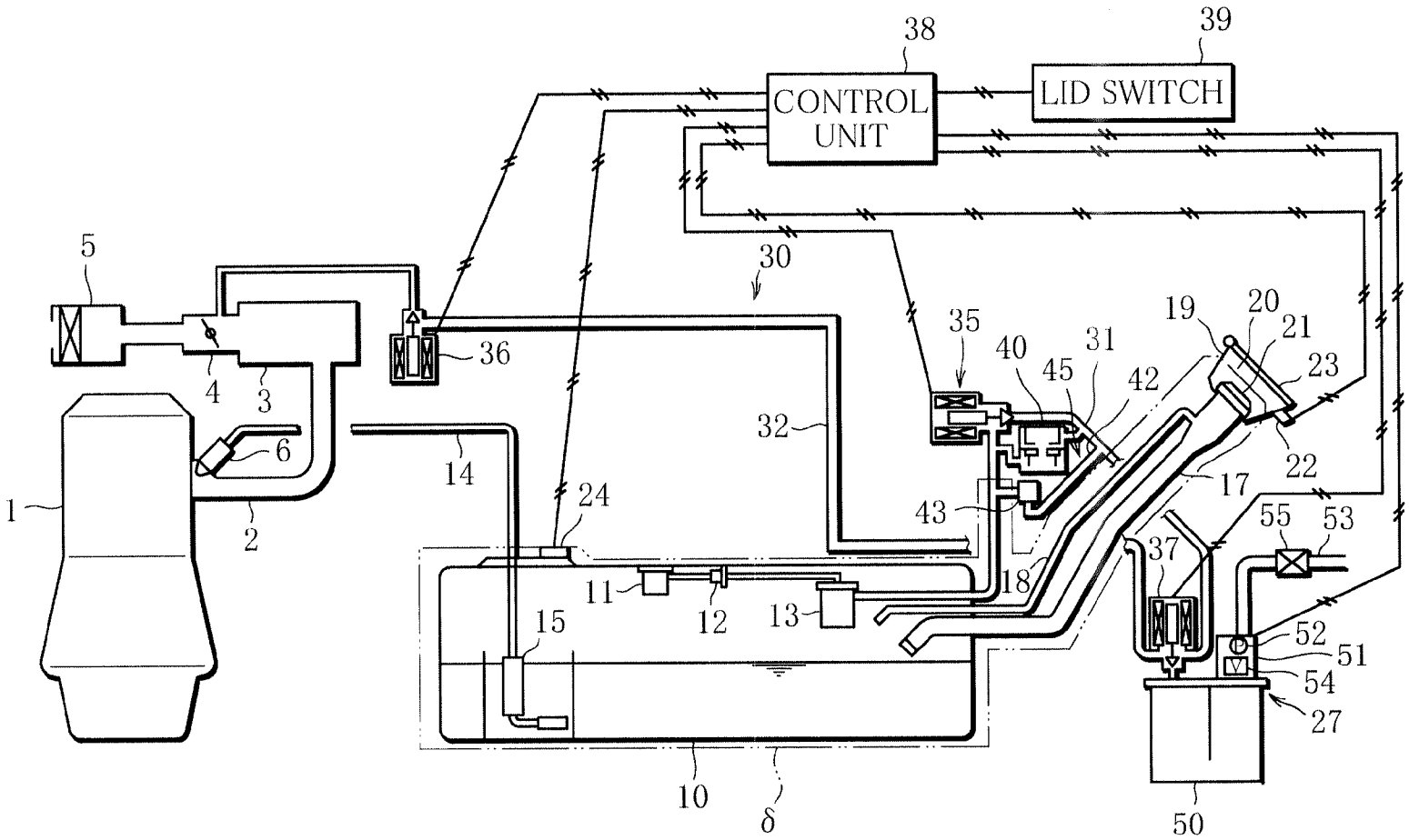
FIG. 13 illustrates a schematic configuration of a vehicular fuel apparatus according to a fourth embodiment of the present invention, together with a bypass passage and a bypass valve.

FIG. 13 illustrates a schematic configuration of a fuel apparatus according to the fourth embodiment of the present invention applied to a vehicle, for example, a hybrid vehicle using the combination of a traveling motor and an engine, and FIGS. 14 to 18 illustrate structures of various parts of the fuel apparatus and the manner of how the various parts are operated and controlled.

The fuel apparatus illustrated in FIG. 13 has a basic configuration identical with that of the first to third embodiments illustrated in FIG. 1. Thus, like reference numerals are used to denote like parts appearing in FIG. 1, and description of such parts is omitted. In the following, only the difference between the configuration of the fourth embodiment and that illustrated in FIG. 1 will be explained. In the fourth embodiment, the vapor passage 31 is provided with a bypass structure 45 as a means of coping with leak of the evaporation gas, which connects the interior of the fuel tank 10 to the canister 50 when it is judged by the leak check that the evaporation gas is leaking (leak is detected).

The bypass structure 45 comprises a bypass passage 42 (corresponding to the bypass passage) connecting upstream and downstream portions of the vapor passage 31 located upstream and downstream, respectively, of the sealing valve 35, for example, a portion of the upstream portion immediately upstream the safety valve 40 and a portion of the downstream portion immediately downstream the safety valve 40 to each other, and a bypass valve 43 provided in the bypass passage 42. An overall structure of the bypass valve 43 is illustrated in FIGS. 14 and 15, and a principal part of the bypass valve 43 is illustrated in FIG. 16.

Figure 14:
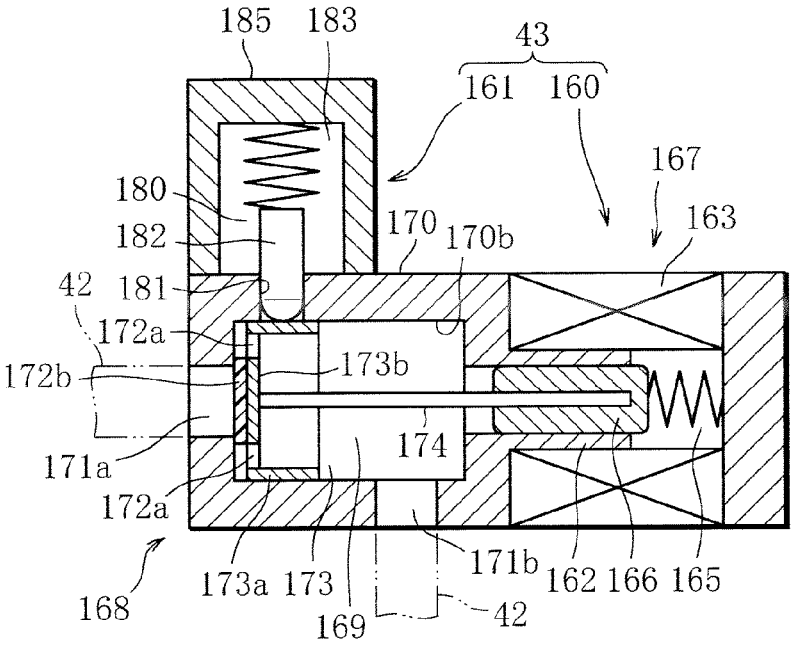
FIG. 14 is a sectional view illustrating the structure of the bypass valve in a closed state.
Figure 15:
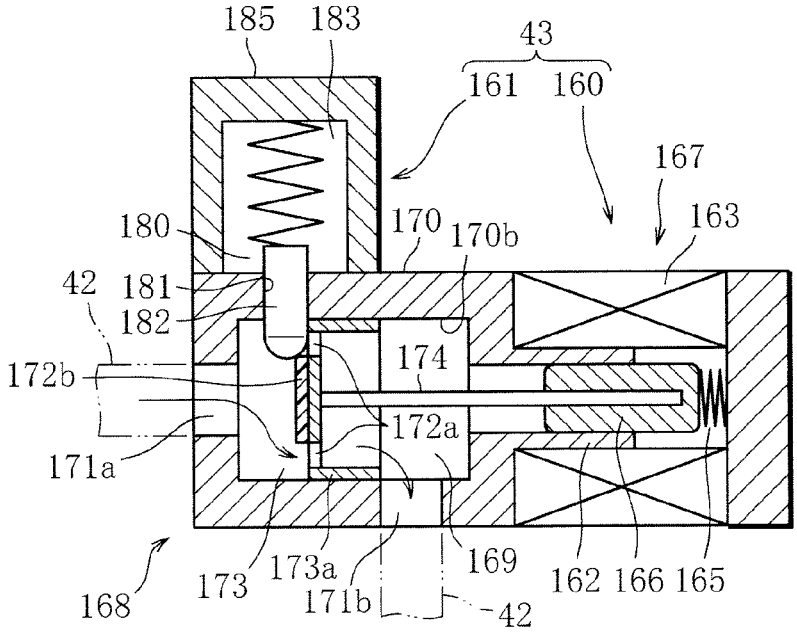
FIG. 15 is a sectional view illustrating the bypass valve in an open state.
Figure 16:
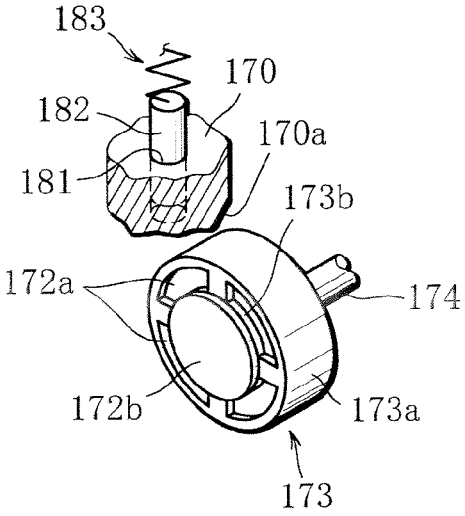
FIG. 16 is a perspective view illustrating the structure of a principal part of the bypass valve.

As illustrated in FIGS. 14 and 15, the bypass valve 43 is constituted by the combination of a normally closed electromagnetic on-off valve 160 and a locking device 161 capable of changing the state of the normally closed electromagnetic on-off valve 160 to a normally open state.

Specifically, the electromagnetic on-off valve 160 includes, for example, a solenoid 167 having an annular winding of coil 163 disposed around a cylinder 162, which is a slender cylindrical yoke, and a plunger 166 received, together with a return spring 165, in the cylinder 162 for reciprocating motion; and a valve portion 168 provided at a distal end of the cylinder 162. The valve portion 168 includes a valve body 170 having an I-shaped valve chamber 170*a* formed therein, a pair of communication ports 171*a* and 171*b* formed in a central portion of the distal end wall and the peripheral wall, respectively, of the valve chamber 170*a*, and a cylindrical valve member 173 closed at one end and slidably received in the valve chamber 170*a* of the valve body 170. As the valve member 173 moves, a flow passage 169 between the communication ports 171*a* and 171*b* is opened or closed. Specifically, the valve member 173 has a peripheral wall 173*a* disposed in sliding contact with the inner peripheral surface of the valve chamber 170*a*. Also, as illustrated in FIG. 16, the valve member 173 has a plurality of arcuate through holes 172*a* formed through a front wall 173*b* thereof near the outer periphery, and a circular seat 172*b* (with a diameter larger than that of the communication port 171*a*) located at the center of the front wall 173*b*. The communications ports 171*a* and 171*b* are located in the middle of the bypass passage 42.

The plunger 166 is coupled to the valve member 173, more specifically, the central portion of the front wall 173*b*, by a connecting rod 174 so that the valve member 173 may be displaced as the solenoid 167 is switched from a de-energized state to an energized state or vice versa, to open or close the front communication port 171*a*. Specifically, while the coil 163 is de-energized (no current is supplied), the front communication port 171*a* is closed with the seat 172*b* of the valve member 173 urged by the return spring 165 (FIG. 14), and when the coil 163 is energized (current is supplied), the front communication port 171*a* is opened because the valve member 173 retracts together with the seat 172*b*, so that the communication ports 171*a* and 171*b* communicate with each other (FIG. 15). Namely, the electromagnetic on-off valve 160 is a normally closed valve which closes the bypass passage 42 when de-energized, and which opens the bypass passage 42 when energized.

The locking device 161 comprises, as shown in FIGS. 14 to 16 by way of example, a lock mechanism 180 attached to the peripheral wall of the valve body 170, and a solenoid energization control function (corresponding to the energization control unit) of the control unit 38. As illustrated in FIGS. 14 to 16 by way of example, the lock mechanism 180 is constituted by the combination of a pin hole 181 penetrating diametrically through the peripheral wall of the valve body 170, a pin member 182 (corresponding to the lock member) slidably inserted into the pin hole 181, a compression spring 183 (corresponding to the elastic member) urging the pin member 182 toward the inside of the valve body 170, and an engagement structure for engaging the urged pin member 182 with the valve member 173 in an open position. The compression spring 183 and the pin member 182 located outside of the valve body 170 are covered with a cover member 185 so that the spring 183 may be supported by the cover member 185.

The location of the pin hole 181 is set such that when the valve member 173 is in a closing position, the inner end of the pin hole 181 is closed with the peripheral wall of the valve member 173 as shown in FIG. 14, and that when the valve member 173 is in the open position, the lower end of the pin hole 181 is exposed, or open, as shown in FIG. 15. Accordingly, while the coil 163 is de-energized, that is, when the valve member 173 is in the closing position, the pin member 182 stays in a standby position flush with the peripheral wall 173*a* of the valve member 173, and when the coil 163 is energized to displace the valve member 173 to the open position, the pin member 182 projects into the valve chamber 170*a*. As a consequence, the distal end of the pin member 182 engages with a locking portion (corresponding to the locking portion) of the valve member 173 in the open position, more specifically, an edge of the peripheral wall 173*a* (including the front wall 173*b*) of the valve member 173, whereby the valve member 173 is locked in the open position.

The solenoid energization control function includes performing leak check on the fuel tank 10 and, if leak of the evaporation gas from within the fuel tank 10 to outside is detected, energizing the solenoid 167 and thereafter de-energizing the solenoid 167. Specifically, when leak of the evaporation gas is detected, the valve member 173 is displaced to the open position by energizing the solenoid 167. As a result, the valve member 173 is locked in the open position by the projecting pin member 182. Although the solenoid 167 is de-energized thereafter, the engaged state of the valve member 173 is maintained by the elastic force of the compression spring 183 and the elastic force of the return spring 165, so that the valve member 173 is held in the open position (normally open state). By virtue of such control, leak of the evaporation gas from the leaky spot can be restrained.

Figure 17:
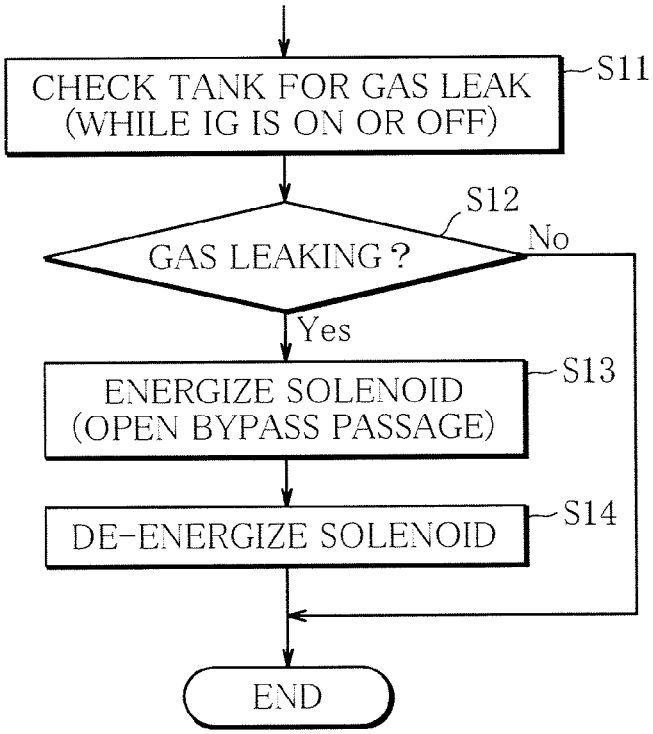
FIG. 17 is a flowchart illustrating a control procedure for opening the bypass passage when a fuel leak from the closed space of a fuel tank is detected.
Figure 18:
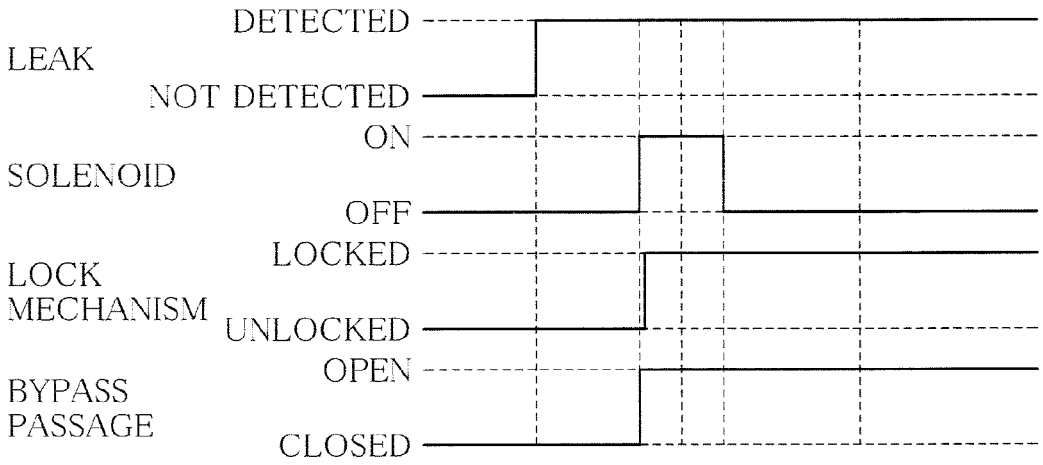
FIG. 18 is a timing chart illustrating the states of various parts during the control process.

A control procedure for restraining leak of the evaporation gas is illustrated in the flowchart of FIG. 17 and the timing chart of FIG. 18.

Referring now to FIGS. 14, 15, 17 and 18, the technique of restraining leak of the evaporation gas will be explained. As shown in Step S11 of FIG. 17, leak of the evaporation gas from within the fuel tank 10 of the sealing system is checked at an appropriate time while the ignition switch (IG) is on or off.

The leak check is conducted by operating the negative pressure pump 52, switching the selector valve 54 and opening the sealing valve 35 to introduce the negative pressure generated by the negative pressure pump 52 into the fuel tank 10 until the internal pressure of the fuel tank 10 lowers to the predetermined pressure, then leaving the fuel tank 10 in the sealed state at the predetermined pressure, and determining, based on change of the internal pressure of the fuel tank 10 after a lapse of the predetermined time, whether or not the evaporation gas is leaking from the region 5 including the interior of the fuel tank 10.

If it is found at this time that the internal pressure of the fuel tank 10 has changed, it is concluded that there is a leaky spot in the region 5 from which the evaporation gas in the fuel pump 10 is leaking to the outside, as indicated by "LEAK DETECTED" in FIG. 18. Thereupon, the flow proceeds from Step S12 to Step S13 in which the solenoid 167 is energized. Accordingly, the plunger 166 is retracted to displace to valve member 173 up to the open position such that the seat 172*b* is set apart from the communication port 171*a* (FIG. 15). As a result, the communication port 171*a* opens and communicates with the communication port 171*b*. In this manner, the bypass passage 42 is opened.

Since the valve member 173 is displaced up to the open position, the pin hole 181 is exposed, and therefore, the pin member 182 in the standby position projects in front of the front wall 173*b* of the valve member 173 and interferes with the valve member 173 to restrict movement of the valve member 173 toward the closing position. That is, the valve member 173 is locked in the open position. Subsequently, the flow proceeds to Step S14, in which the solenoid 167 is de-energized. The valve member 173 remains locked in the open position despite normalcy, or de-energization. In this manner, the state of the bypass valve 43 is changed from the normally closed state to the normally open state. The bypass valve 43 in the normally open state allows the bypass passage 42 to keep opening.

Consequently, most part of the evaporation gas leaking from within the fuel tank 10 is guided from the bypass passage 42 bypassing the sealing valve 35 to the vapor passage 31 (flow resistance: small), which has a larger flow passage area than the minute leaky spot, and reaches the canister 50. The evaporation gas is adsorbed by the activated charcoal in the canister 50. In this case, the selector valve 54 of the leak check module 51 is switched to the atmospheric vent side, in order to facilitate adsorption of the evaporation gas.

Thus, even in the event that the evaporation gas leaks to the outside of the fuel tank 10, most part of the evaporation gas is adsorbed in the canister 50, so that the evaporation gas released from the leaky spot of the fuel tank 10 can be reduced to a minimum.

The bypass valve 43 includes the locking device 161 capable of locking the valve member 173 of the electromagnetic on-off valve 160 in the open position, and accordingly, even in cases where leak of the evaporation gas from within the fuel tank 10 is detected while the vehicle is parked, the bypass valve 43 can be kept in the open state. Especially, since the electromagnetic on-off valve 160 is soon de-energized, it is possible to prevent unnecessary consumption of the electric power of the battery mounted on the vehicle.

Further, the locking device 161 is simple in structure because it has only to include the combination of the pin member 182, the compression spring 183 and the locking portion (edge of the peripheral wall 173*a*) for engaging with the urged pin member 182 and be combined with the control for de-energizing the solenoid 167. Furthermore, since the structure of the locking device 161 is simple, it is possible to prevent malfunction and the like.

Figure 19:
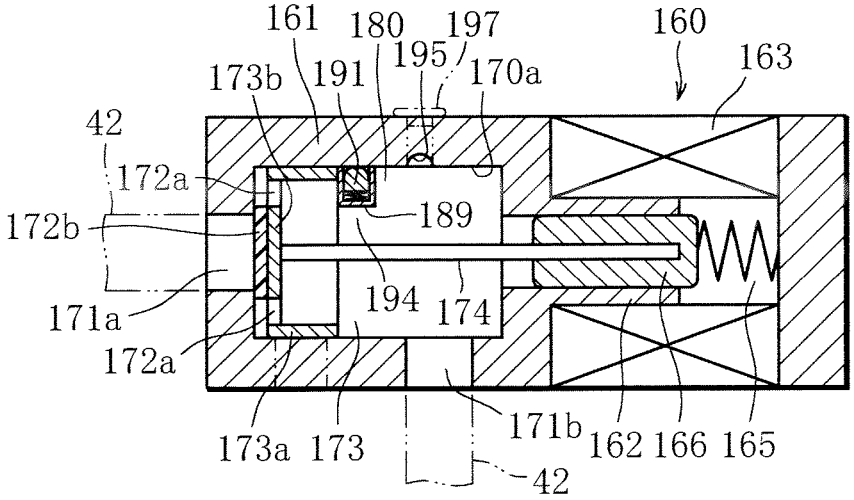
FIG. 19 is a sectional view illustrating a bypass valve as a principal part of a fifth embodiment of the present invention.
Figure 20:
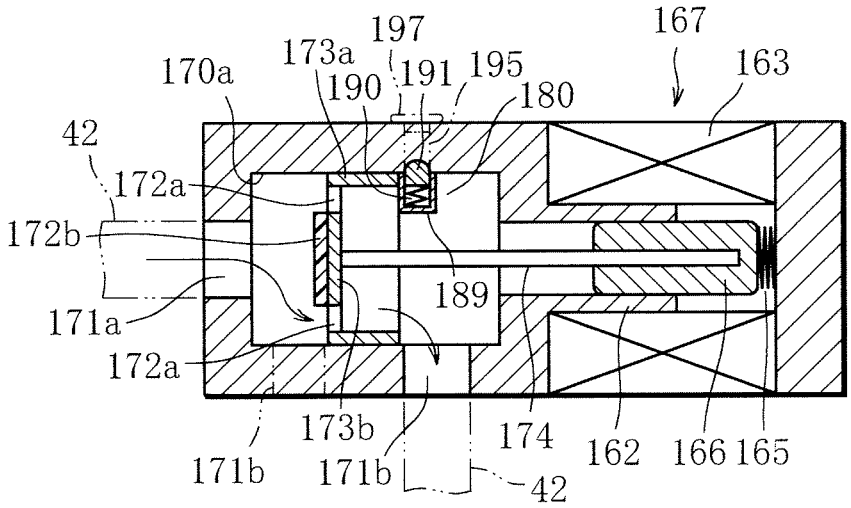
FIG. 20 is a sectional view illustrating an open state of the bypass valve.

FIGS. 19 and 20 illustrate a fifth embodiment of the present invention.

The fifth embodiment is a modification of the fourth embodiment, and in this embodiment, the lock mechanism 180 is provided on the valve member 173, unlike the fourth embodiment in which the lock mechanism 180 is provided on the valve body 170.

Specifically, the lock mechanism 180 includes, for example, a pin module 194 arranged in the peripheral wall 173*a* of the valve member 173 and having a compression spring 190 and a pin member 191 received within a holder 189 so that the pin member 191 can project from the holder 189, and a locking hole 195 formed in the inner peripheral surface of the valve chamber 170*a* and capable of engaging with a distal end of the pin member 191. When the valve member 173 is displaced (retracted) up to the open position, the pin member 191 projects and engages with the locking hole 195, so that the valve member 173 is locked in the open position (FIG. 20).

Also with the lock mechanism 180 configured as above, leak of the evaporation gas from the leaky spot of the fuel tank 10 can be minimized using a simple structure, as in the fourth embodiment.

Further, as indicated by the dot-dot-dash lines in FIGS. 19 and 20, a through hole penetrating through the valve body 170 may be formed in place of the locking hole 195, and the location of the communication port 171*b* communicating sideways with the valve chamber 170*a* may be changed such that the communication port 171*b* is closed with the peripheral wall 173*a* of the valve member 173 in the closing position. In this case, after the leaky spot of the fuel tank 10 is repaired, a suitable tool, for example, the tip of a screwdriver may be inserted from outside into the through hole to push in the pin member 191, whereupon the bypass valve 43 is restored to the normally closed state, so that the bypass valve 43 can be reused repeatedly. The outer open end of the through hole (locking hole 195) is of course closed with a lid member 197 to prevent passage of water or gas from the canister 50.

In FIGS. 19 and 20, like reference numerals are used to denote like component parts of the fourth embodiment, and description of such component parts is omitted.

Although the fourth and fifth embodiments employ structures for locking the bypass valve in the open state by using the pin member, other suitable structure may be used to lock the bypass valve in the open state when leak of the evaporation gas is detected, and to keep the bypass passage open thereafter.

In the aforementioned first to fifth embodiments, the sealing system using a canister valve is exemplified, but the sealing system to which the invention is applicable is not limited to such a sealing system and may be a sealing system using no canister valve.

What is claimed is:

1. A fuel apparatus for a vehicle, comprising:

a fuel tank storing fuel;

a canister that adsorbs evaporation gas of the fuel produced in an interior of the fuel tank;

a vapor passage connecting the interior of the fuel tank and the canister to each other to guide the evaporation gas in the fuel tank to the canister;

a sealing valve provided in the vapor passage and, in normal condition, closing the vapor passage to keep the interior of the fuel tank in a sealed state;

a leak detection portion which detects leak of the evaporation gas from a closed space of the fuel tank in the sealed state to outside; and an opening control portion which opens the sealing valve when leak of the evaporation gas from within the fuel tank is detected by the leak detection portion, wherein the opening control portion includes, a valve member that opens and closes the vapor passage, an electromagnetic on-off valve including a solenoid which moves the valve member to an open position to open the vapor passage when energized and which moves the valve member to a closing position to close the vapor passage when de-energized in the normal condition, and a changeover portion which locks the valve member in the open position when leak of the evaporation gas is detected, and maintains the valve member in the open position even when the solenoid is de-energized.

2. The fuel apparatus according to claim 1, wherein: the changeover portion includes a lock that locks the valve member in the open position, and an actuator that actuates the lock so as to lock the valve member.

3. The fuel apparatus according to claim 1, wherein: the electromagnetic on-off valve that moves depending on an exciting voltage applied to the solenoid, the valve member to a first open position in which the vapor passage is opened, and a second open position farther from a closing position of the valve member than the first open position, and the changeover portion includes a switching portion which moves the valve member to the second open position when leak of the evaporation gas is detected, and a locking portion which restricts movement of the valve member moved to the second open position.

4. A fuel apparatus for a vehicle, comprising:

a fuel tank storing fuel;

a canister that adsorbs evaporation gas of the fuel produced in an interior of the fuel tank;

a vapor passage connecting the interior of the fuel tank and the canister to each other to guide the evaporation gas in the fuel tank to the canister;

a sealing valve provided in the vapor passage and closing the vapor passage to keep the interior of the fuel tank in a sealed state;

a bypass passage connecting an upstream portion of the vapor passage located upstream of the sealing valve and a downstream portion of the vapor passage located downstream of the sealing valve to each other to bypass the sealing valve;

a leak detection portion which detects leak of the evaporation gas from a closed space of the fuel tank in the sealed state to outside; and a bypass valve which opens the bypass passage in a closed state when leak of the evaporation gas from within the fuel tank is detected by the leak detection portion, wherein the bypass valve is a normally closed electromagnetic on-off valve which closes the bypass passage when de-energized and which opens the bypass passage when energized, and the bypass valve includes a locking device which locks the electromagnetic on-off valve in an open state even when the normally closed electromagnetic on-off valve is de-energized.

5. The fuel apparatus according to claim 4, wherein:

the locking device includes a lock member which locks the electromagnetic on-off valve, an elastic member which urges the lock member, and a locking portion which engages with the urged lock member to lock the electromagnetic on-off valve when the electromagnetic on-off valve is in the open state.

6. The fuel apparatus according to claim 5, further comprising:

an energization control unit which de-energizes the electromagnetic on-off valve after the electromagnetic on-off valve is locked.

* * * * *